US007658620B2

(12) United States Patent
Hsiao et al.

(10) Patent No.: US 7,658,620 B2
(45) Date of Patent: Feb. 9, 2010

(54) ELECTRICAL CONNECTOR HAVING AN IMPROVED FRAME

(75) Inventors: Shih-Wei Hsiao, Tu-cheng (TW); Hsiu-Yuan Hsu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/156,863

(22) Filed: Jun. 4, 2008

(65) Prior Publication Data

US 2008/0299797 A1 Dec. 4, 2008

(30) Foreign Application Priority Data

Jun. 4, 2007 (TW) ..... 96209150

(51) Int. Cl.
*H01R 12/00* (2006.01)

(52) U.S. Cl. ..... 439/71

(58) Field of Classification Search ..... 439/71–74, 439/259

See application file for complete search history.

(56) References Cited

U.S. PATENT DOCUMENTS 6,517,370 B2 * 2/2003 Fukunaga ..... 439/331
6,648,664 B1 * 11/2003 McHugh et al. ..... 439/331
7,121,858 B2 10/2006 Chen
7,248,481 B2 * 7/2007 Trobough ..... 361/785

FOREIGN PATENT DOCUMENTS

CN 201029122 Y 2/2008

* cited by examiner

*Primary Examiner*—Truc T Nguyen
(74) *Attorney, Agent, or Firm*—Andrew C. Cheng; Wei Te Chung; Ming Chieh Chang

(57) ABSTRACT

An electrical connector adapted for connection an Integrated Circuit (IC) chip to a printed circuit board (PCB) includes an insulating housing having a plurality of passageways, a plurality of contacts received in the passageways and a frame moveable assembled on the housing to allow the IC chip to be inserted therein. The frame includes a first and second side walls parallel to each other and a third side wall connecting with ends of the first and second side walls without a sidewall opposite the third wall, thereby a hatch is defined opposite to the third wall.

12 Claims, 4 Drawing Sheets

ELECTRICAL CONNECTOR HAVING AN IMPROVED FRAME

BACKGROUND OF THE INVENTION

1. Field of the Invention

The present invention relates to an electrical connector adapted for an Integrated Circuit (IC) chip, especially to a test socket for an IC chip.

2. Description of Related Art

A conventional test socket usually includes a base portion having a contact array of columns and rows therein, a movable member set in the base portion, a rectangular frame used to drive the movable member to shift. The rectangular frame comprises four side walls to form a rectangular cavity. The rectangular frame is sized to just receive a predetermined sized IC chip. In use actually, the contact array of the socket is designed to be more than a corresponding array of electrical member of the IC chip, which is convenience to test different chips with different electrical member array. The IC chips sometimes will touch the side wall of the frame if the IC chip, when inserted into the frame, closes up to said sidewall, which will result in damage of the IC chip.

Therefore, an electrical connector with an improved frame is desired to overcome the disadvantages of the related arts.

SUMMARY OF THE INVENTION

An object of the present invention is to provide an electrical connector with an improved frame.

In order to achieve above-mentioned object, an electrical connector adapted for connection an Integrated Circuit (IC) chip to a printed circuit board (PCB) comprises an insulating housing having a plurality of passageways, a plurality of contacts received in the passageways and a frame moveable assembled on the housing to allow the IC chip to be inserted therein. The frame comprises a first and second side walls parallel to each other and a third side wall connecting with ends of the first and second side walls without a sidewall opposite the third wall, thereby a hatch is defined opposite to the third wall.

Other objects, advantages and novel features of the present invention will become more apparent from the following detailed description of the present embodiment when taken in conjunction with the accompanying drawings.

DETAILED DESCRIPTION OF THE INVENTION

Figure 1:
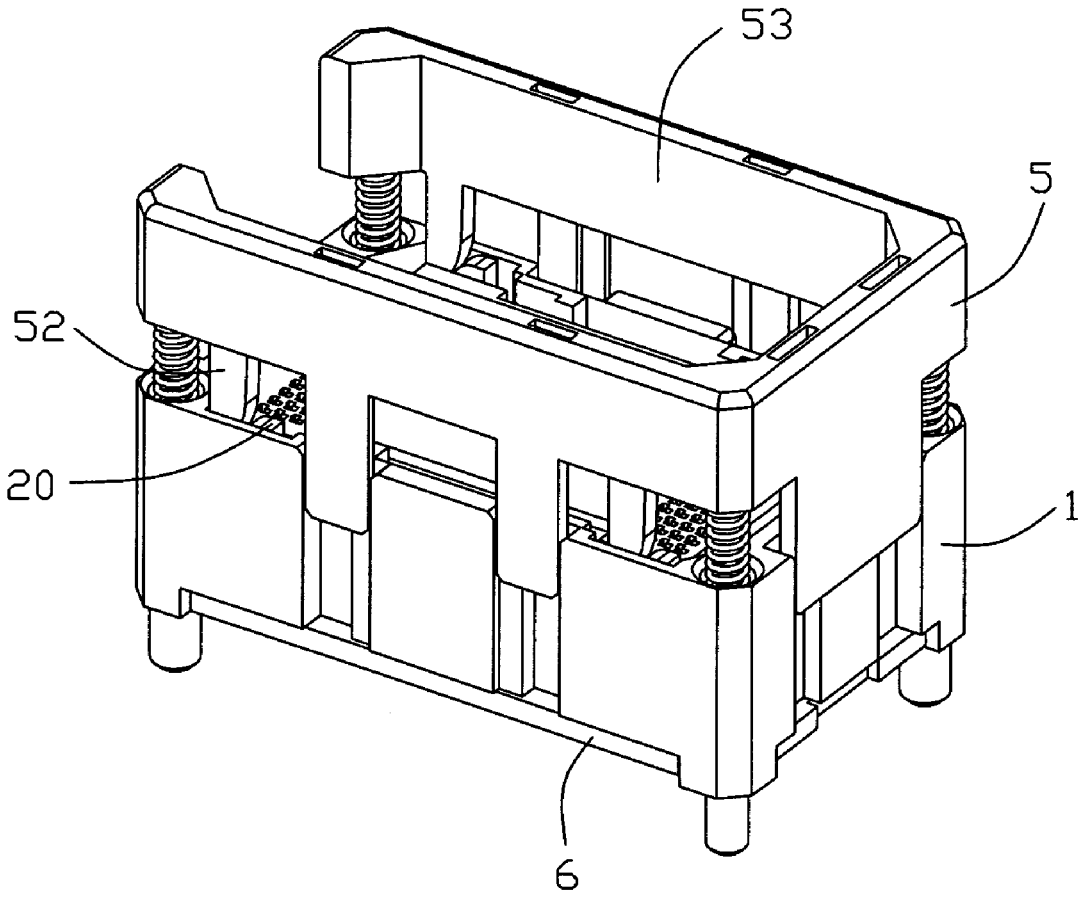
FIG. 1 is a perspective view of an electrical connector of a preferred embodiment of the present invention.

Reference will now be made to the drawing figures to describe a preferred embodiment of the present invention in detail.

Figure 2:
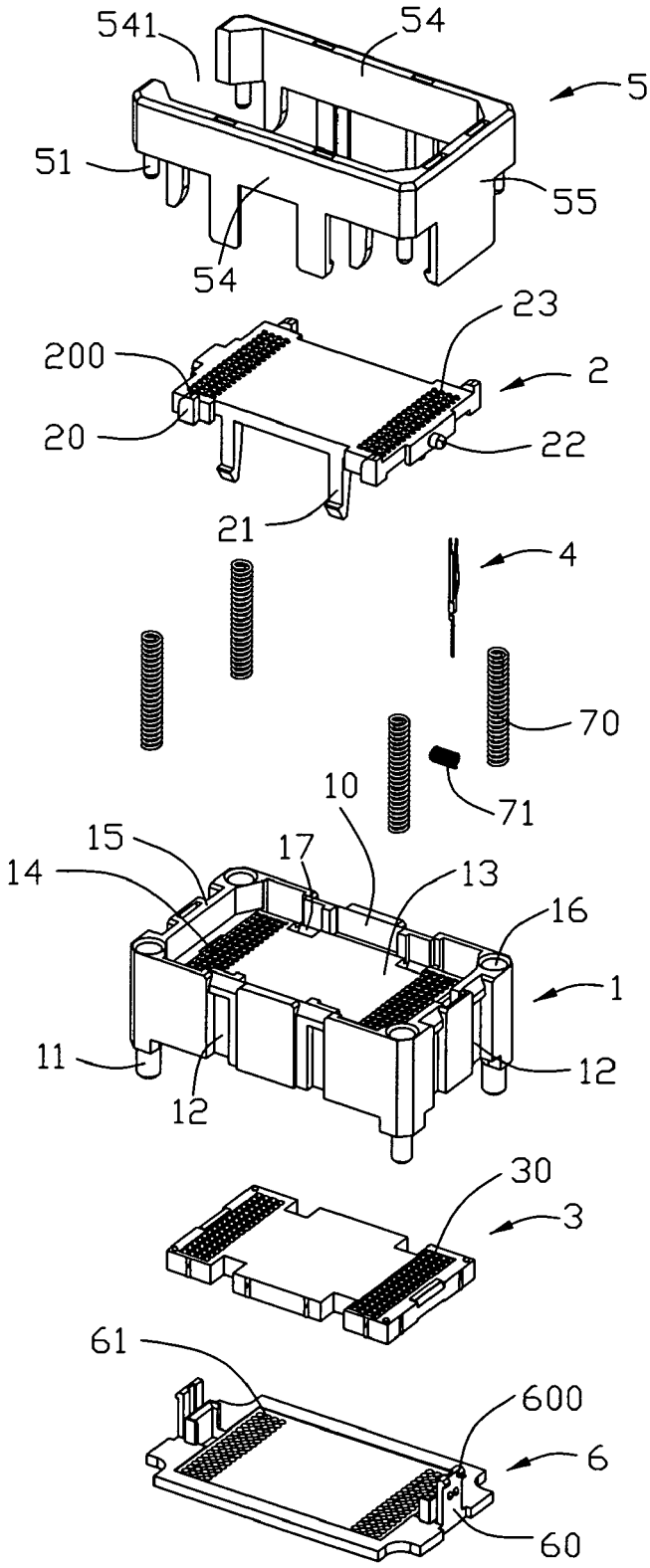
FIG. 2 is an exploded perspective view of the electrical connector shown in FIG. 1.

Referring to FIGS. 1 and 2, an electrical connector used to electrically and mechanically connect an IC chip especially a ball grid array chip (not shown), mainly includes an insulating housing 1 having an upper-opening receiving cavity 10, a supporting member 2 received in the receiving cavity 10, an integral frame 5 set on the housing 1 and a fixing member 3 accepted in the bottom of the housing 1. The connector further includes a plurality of contacts received through the housing, the supporting member and the fixing member (only one contact is shown in FIG. 2).

Referring to FIG. 2, the housing 1 has a centre bottom wall 13 and four side walls 15 perpendicular to the bottom wall 13 to form the upper-opening receiving cavity 10. The bottom wall 13 defines a plurality of passageways 14 running though in the up and down direction. The outer faces of the side walls 15 define guiding grooves 12 in the up and down direction. Four receiving holes 16 are defined at four corners of side walls 15 respectively to receive spring elements such as four first coil spring members 70, and four retaining posts 11 each extends downwards from the housing 1 at the opposite of the receiving holes 16 for retaining the housing to the PCB.

The supporting member 2 is received in the receiving cavity 10 of the housing 1 and defines a plurality of passageways 23 aligned with the passageways 14 of the housing 1. Four protrusions 20, each with an arc shaped guiding face 200 are defined at two opposite sides of the supporting member 2 adjacent to the four corners. Four hook portions 21 extending downwards respectively adjacent the protrusions 20, run through corresponding slot 17 and slaw the bottom wall 13 of the housing 1 to retain the supporting member 2 in the receiving cavity 10. An outwardly second post portion 22 is defined at an end side of the supporting member 2 and a second coil spring member 71 is assembled on the post portion 22.

Figure 3:
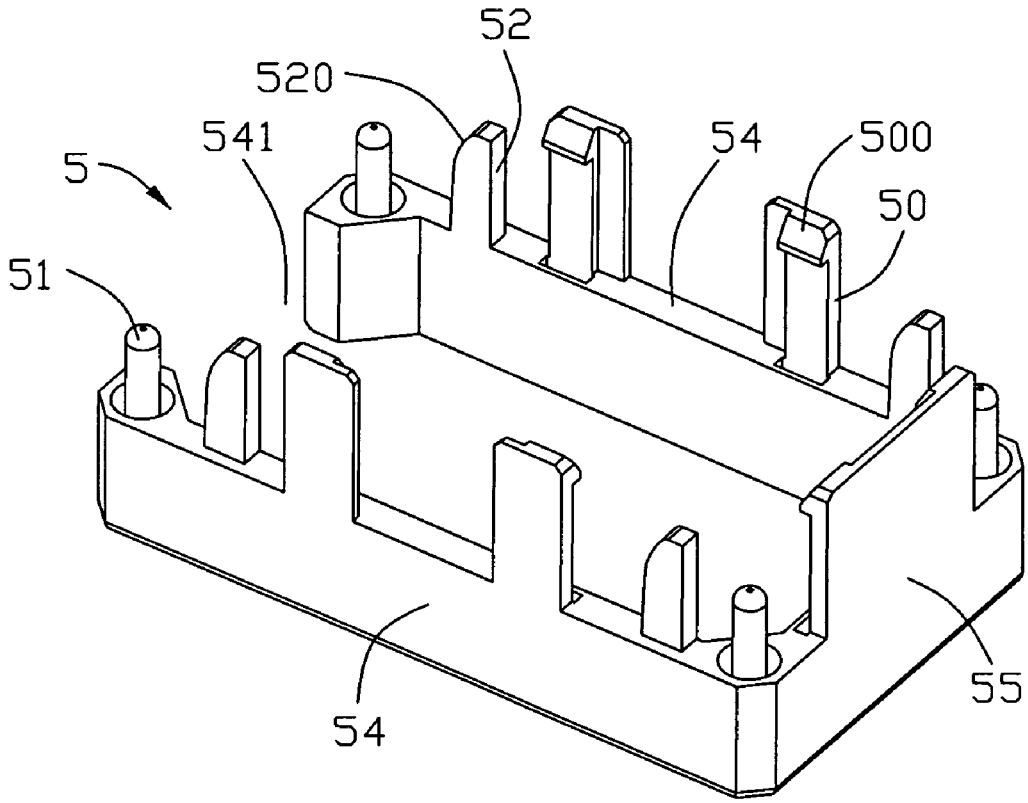
FIG. 3 is an enlarged perspective view of the frame shown in FIG. 2.

Referring to FIGS. 2 and 3, the frame 5 has three side walls, two parallel longer side walls 54 and a short side wall 55 perpendicularly connecting with ends of said longer side walls 54, another ends of the longer side walls define a hatch 541 therebetween. The side walls define a U-shape receiving space 53 to received the IC chip. Five retaining portions 50 with hook sections 500 extending downwards from side walls, are used to cooperate with the guiding grooves 12 of the housing 1 so that the frame 5 are assembled on the housing 1 and slide along the guiding grooves 12. Four post portion 51 extend downwards and are received in the first coil springs 70 received in the receiving holes 16, which urge the frame 5 to shift upwards and downwards. Two pairs of actuating portions 52 extending downwards from the opposite side walls 54 respectively have slanting faces 520 to press against the arc shaped guiding faces 200 of the protrusions 20.

The three side walls 54, 55 of frame support the chip therein. The hatch 541 allow the chip to be inserted even if the chip is slightly larger than the frame of the chip or closes up to the hatch 541 since one end of the chip can go across the hatch. The short side wall 55 is also used to limit the chip in the frame. As a result, the side walls of three ensure the chip from broken but stably received in the frame.

The fixing member 3 is retained in bottom of the housing 1 by a retaining device like some blots (not shown). The fixing member 3 has a plurality of passageways 30 aligned with the passageways 14 of the housing 1 and the passageways 23 of supporting member 2.

Figure 4:
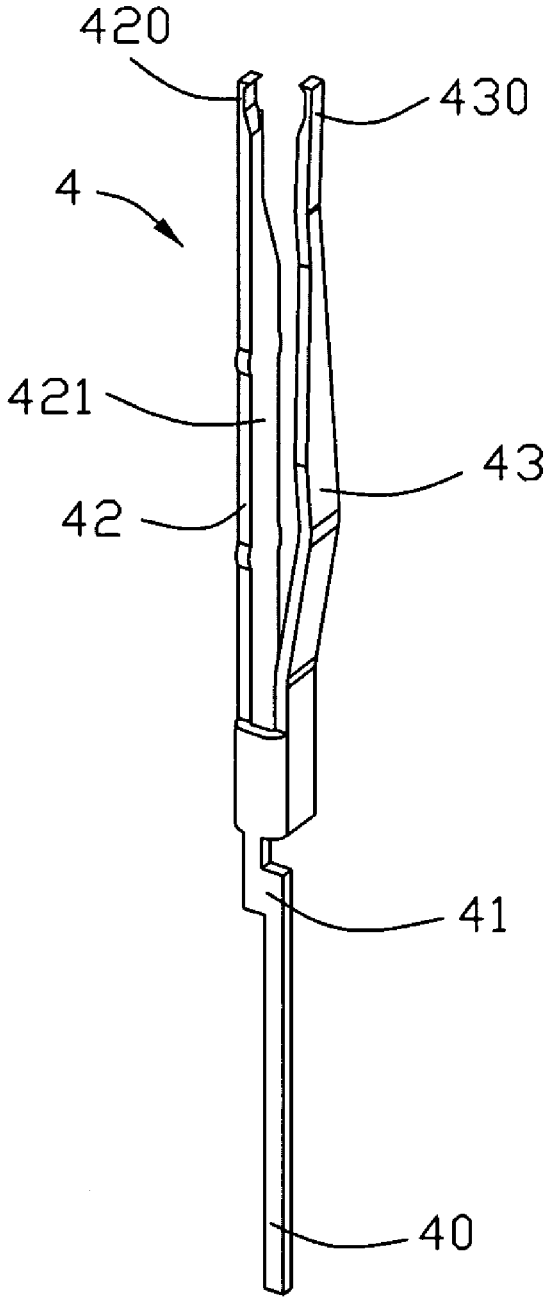
FIG. 4 is an enlarged perspective view of the contact shown in FIG. 2.

Referring to FIG. 4, the contacts are received in the passageways 23 of the supporting member 2, the passageways 14 of the housing 1 and the passageways 30 of the fixing member 3. The contact 2 includes a solder leg 40 for being soldered on a PCB, a bending portion 41 having an offset to the solder leg 40 and a pair of slim arm portion 42, 43 extending upwardly forms the bending portion 41. The two arm portions join at bottom ends thereof and one arm portion 42 is used as a stationary arm while the other arm portion 43 is used as a movable arm. The top portions of the two arm portions offset in projection plane 421, namely not overlap or partly overlap, and define clamping portions 420, 430 at the top ends thereof.

A protecting board 6 locating under the fixing member 3 has a pair of latching member 60 including locking portions 600 for latching with the housing to protect the contacts from being destroyed.

When an exterior force is exerted on the frame 5, the frame 5 is driven downwards until a final position where the posts 51 are fully received in the holes 16. During the process, all the coil springs is compressed and the IC chip can be put into the U-shape receiving space 53. Meanwhile the actuating portions 52 press against the protruding portion 20 to urge the supporting member 2 to shift to another end of the receiving cavity 10. As a result, movable arms 43 shift away from the stationary arm 42 so that the gap between the clamping portions 420, 430 are larger than the diameter of the solder balls of the IC chip. The solder balls are easy to enter into the clamping portions. The coil spring members will restore after the exterior force withdraws and the movable arms will return back to lock the solder balls of the IC chip. The IC chip can be taken out if an exterior force is exerted on the actuating member again.

However, the disclosure is illustrative only, changes may be made in detail, especially in matter of shape, size, and arrangement of parts within the principles of the invention.

What is claimed is:

1. An electrical connector adapted for connection an Integrated Circuit (IC) chip to a printed circuit board (PCB), comprising:

an insulating housing having a plurality of passageways;

a plurality of contacts received in the passageways; and a frame moveable assembled on the housing to allow the IC chip to be inserted therein, comprising a first and second side walls parallel to each other and a third side wall connecting with ends of the first and second side walls without a sidewall opposite the third wall, thereby a hatch is defined opposite to the third wall;

wherein the frame has retaining portions with hook sections extending downwards from the side walls to fix the frame to the housing;

wherein the frame has post portions each with a spring element received in a corresponding receiving hole of the housing.

2. The electrical connector as described in claim 1, wherein the frame defines a U-shape receiving space to receive the IC chip therein.

3. The electrical connector as described in claim 1, wherein the first and second side walls is longer than the third side wall.

4. The electrical connector as described in claim 1, wherein a supporting member is received in the housing and have protrusions pressed by actuating portion of the frame.

5. The electrical connector as described in claim 1, wherein said frame is of one piece unitarily.

6. An electrical connector for connection an Integrated Circuit (IC) chip to a printed circuit board (PCB), comprising:

an insulating housing having a plurality of passageways;

a plurality of contacts received in the passageways; and a frame up and down moveable assembled on the housing and allowing the IC chip to be loaded therethrough into the housing, said frame defining four sides with thereof one side being essentially laterally open to an exterior so as to not only provide flexibility and capability of receiving a longer IC chip which extends throughout said one side, but also maintain strength of the frame via the other three side joined together;

wherein the frame has retaining portions with hook sections extending downwards from the side walls to fix the frame to the housing;

wherein the frame has post portions each with a spring element received in a corresponding receiving hole of the housing.

7. The electrical connector as claimed in claim 6, wherein said four sides include two opposite long sides and two opposite short sides, and said one side belongs to the short side.

8. The electrical connector as claimed in claim 6, wherein at least two of said three other sides are equipped with latching devices and guiding device to assure up-and-down movement of the frame with regard to the housing without risk of being withdraw.

9. The electrical connector as claimed in claim 8, wherein all side other three sides are equipped with the latching devices, respectively.

10. The electrical connector as claimed in claim 6, wherein urging devices are provided between the frame and the housing to actuate upward moment of the frame with regard to the housing.

11. The electrical connector as described in claim 6, further including four chamfered structures at four corners of said four sided frame.

12. The electrical connector as described in claim 6, wherein said other three sides are all equipped with corresponding latching devices for cooperating with the housing.

* * * * *